US008602904B2

(12) United States Patent
Tuckey et al.

(10) Patent No.: US 8,602,904 B2
(45) Date of Patent: Dec. 10, 2013

(54) SWING APPARATUS AND CONTROL SYSTEM AND METHOD THEREFOR

(75) Inventors: Peter Tuckey, Morgantown, PA (US); William Dreschel, State College, PA (US)

(73) Assignee: Wonderland Nurserygoods Company Limited, Hong Kong (HK)

( * ) Notice: Subject to any disclaimer, the term of this patent is extended or adjusted under 35 U.S.C. 154(b) by 299 days.

(21) Appl. No.: 13/100,573

(22) Filed: May 4, 2011

(65) Prior Publication Data

US 2011/0275445 A1 Nov. 10, 2011

Related U.S. Application Data

(60) Provisional application No. 61/395,194, filed on May 10, 2010.

(51) Int. Cl.
*A63G 9/16* (2006.01)
*A63G 9/00* (2006.01)

(52) U.S. Cl.
USPC ..... 472/119

(58) Field of Classification Search
USPC ..... 472/118–125; 297/273, 274, 281, 284
See application file for complete search history.

(56) References Cited

U.S. PATENT DOCUMENTS

| | | | | |
|---|---|---|---|---|
| 5,562,548 | A | 10/1996 | Pinch et al. | |
| 6,017,088 | A | 1/2000 | Stephens et al. | |
| 7,326,120 | B2 * | 2/2008 | Bellows et al. | 472/119 |
| 7,329,192 | B2 * | 2/2008 | Gibree | 472/119 |
| 7,905,791 | B2 * | 3/2011 | Guang et al. | 472/119 |
| 7,918,742 | B2 * | 4/2011 | Clapper et al. | 472/119 |
| 8,215,808 | B2 * | 7/2012 | Daley et al. | 362/459 |
| 2006/0252564 | A1 | 11/2006 | Bellows et al. | |
| 2006/0252566 | A1 | 11/2006 | Gibree | |
| 2007/0010338 | A1 | 1/2007 | Wu et al. | |
| 2009/0111593 | A1 | 4/2009 | Guang et al. | |

FOREIGN PATENT DOCUMENTS

| | | | |
|---|---|---|---|
| CN | 1452931 | A | 11/2003 |
| CN | 101528087 | A | 9/2009 |
| CN | 101548836 | A | 10/2009 |
| GB | 10318900 | A1 | 11/2003 |
| GB | 2426394 | A | 11/2006 |

* cited by examiner

*Primary Examiner* — Kien Nguyen

(74) *Attorney, Agent, or Firm* — David I. Roche; Baker & McKenzie LLP

(57) ABSTRACT

A swing apparatus is adapted to receive the installation of a variety of infant holding devices, such as portable infant seats and bassinets. The infant holding device can be desirably installed and removed from the swing apparatus. In certain embodiments, the support frame of the swing apparatus can be provided with a detector adapted to provide information about the installed infant holding device, in particular an identified type thereof. According to this information, the output of a motion drive unit that is operable to swing the infant holding device can be adjusted to set a suitable swing motion.

20 Claims, 11 Drawing Sheets

SWING APPARATUS AND CONTROL SYSTEM AND METHOD THEREFOR

CROSS-REFERENCE TO RELATED APPLICATION

This patent application claims priority to U.S. Provisional Patent Application No. 61/395,194 filed on May 10, 2010.

BACKGROUND OF THE INVENTION

1. Field of the Invention

The present invention relates to a swing apparatus, and more particularly to a swing apparatus and system and methods of driving the same.

2. Description of the Related Art

Caregivers usually rely on a swing apparatus to facilitate the care of an infant or young child. The swing apparatus can be used to provide a comfortable, safe and entertaining environment to the child. Conventionally, a swing apparatus is made up of a seat or child support that can securely hold the child, and a frame having swing arms from which the seat or child support is suspended. The swing arms are pivotally connected to the frame so as to be able to swing the seat back and forth. In order to meet the preference of the child and caregiver, it may be desirable to have a swing apparatus that can accommodate a variety of detachable child supports. Moreover, to provide optimal comfort the motor output of the swing apparatus has to be properly controlled to generate a suitable swing motion.

Therefore, there is a need for an improved swing apparatus that can drive swing motion in an adjustable manner, and address at least the foregoing issues.

SUMMARY

The present application describes a swing apparatus and a control system and method for the swing apparatus. In one embodiment, the swing apparatus comprises a detachable infant holding device, at least a swing arm pivotally connected with a support frame, wherein the swing arm is adapted to impart a swing motion to the infant holding device, and a detector adapted to provide information about the infant holding device being installed with the swing apparatus.

According to one embodiment, the control system for the swing apparatus comprises a motor drive unit having an output coupled with a swing arm of the swing apparatus, wherein the motor drive unit is operable to drive the swing arm in movement, and a processing unit adapted to adjust the output of the motor drive unit according to a type of an infant holding device installed on the swing apparatus.

In another embodiment, a method of driving the swing apparatus is described. The method comprises providing information about an infant holding device detachably installed on the swing apparatus, and according to the provided information, adjusting an output of a motor drive unit operable to drive a swing motion of the infant holding device.

At least one advantage of the apparatus and method described herein is the ability to adjust the motor output of the swing apparatus according to the type of the infant holding device installed thereon. Accordingly, the most suitable swing motion can be imparted to the infant holding device.

DETAILED DESCRIPTION OF THE EMBODIMENTS

The present application describes a swing apparatus adapted to receive the installation of a variety of infant holding devices. Examples of the infant holding device can include, without limitation, portable infant seats such as car seats, bassinets, and like devices capable of carrying or supporting a child. The infant holding device can be desirably installed and removed from the swing apparatus. In certain embodiments, the support frame of the swing apparatus can be provided with a detector adapted to provide information about the installed infant holding device, in particular an identified type thereof. In alternate embodiments, information about the installed infant holding device may also be directly inputted to a control system of the swing apparatus. According to this information, the output of a motion drive unit that is operable to swing the infant holding device can be adjusted to set a suitable swing motion.

Figure 1:
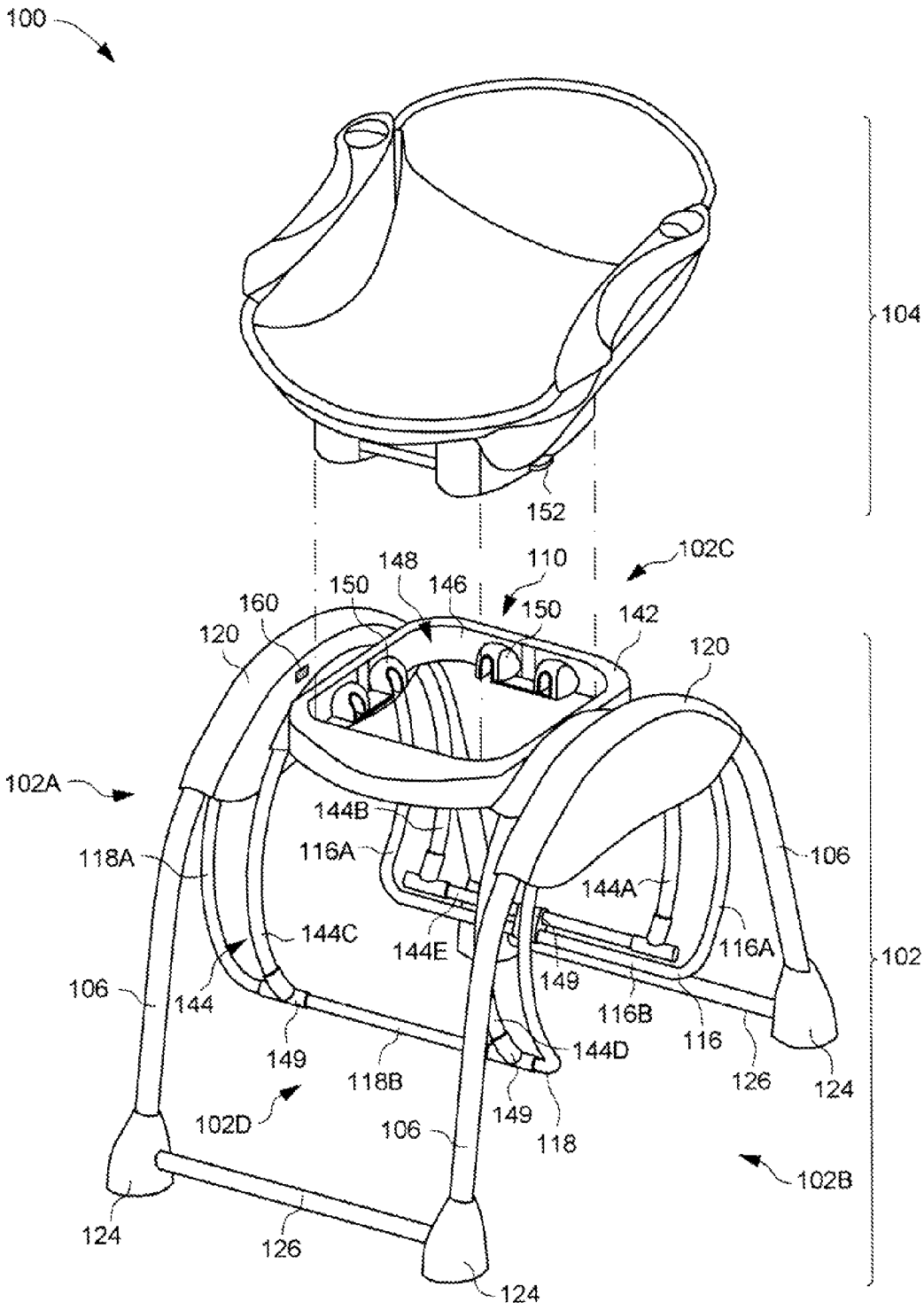
FIG. 1 is a perspective view illustrating one embodiment of a swing apparatus with an infant holding device in a detached state.
Figure 2:
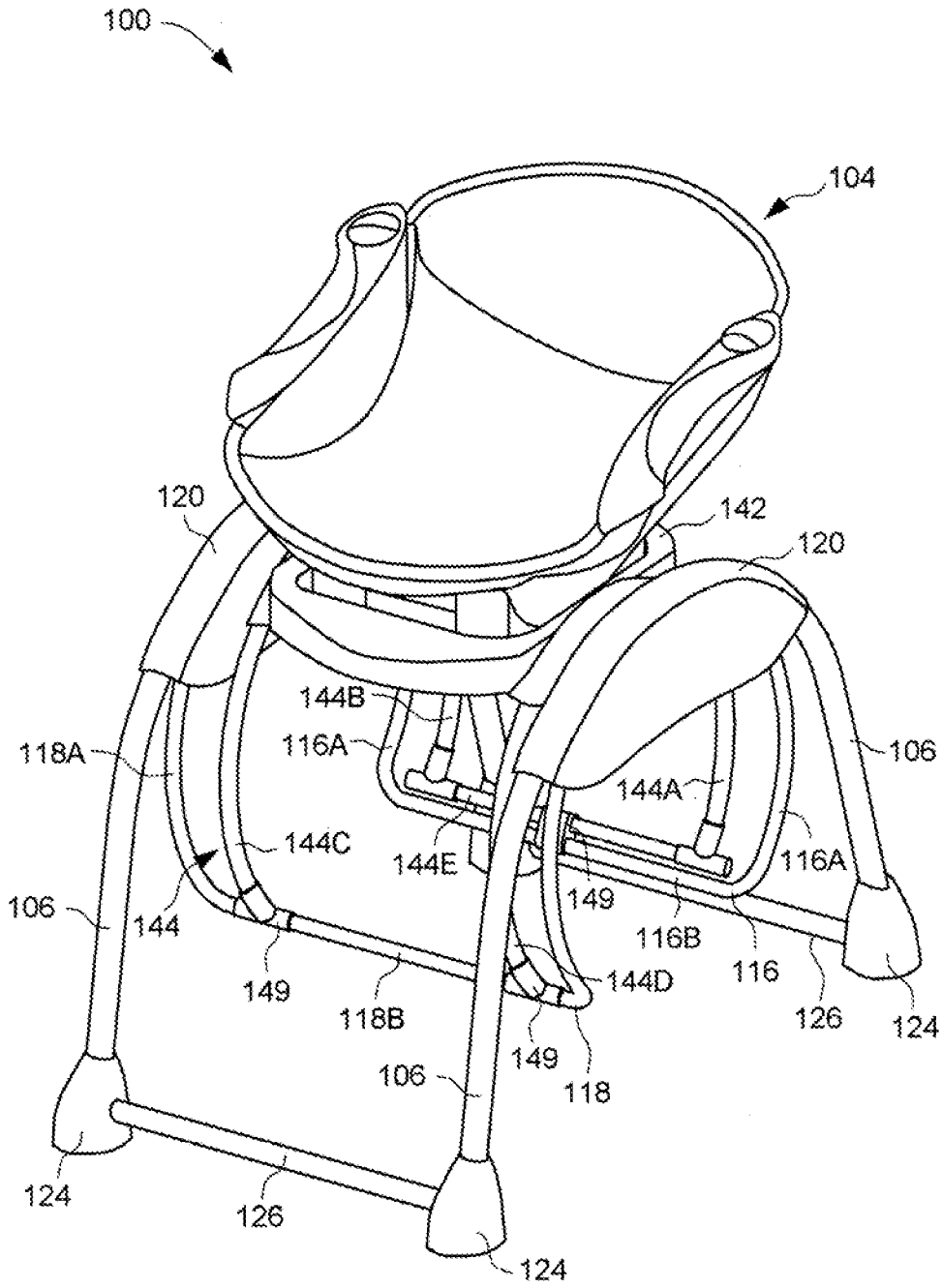
FIG. 2 is a perspective view illustrating the swing apparatus of FIG. 1 with the infant holding device installed thereon.

FIGS. 1 and 2 are perspective views illustrating one embodiment of a swing apparatus 100. The swing apparatus 100 can comprise a support frame 102, and a portable infant holding device 104 that can be detachably installed with the support frame 102 (FIG. 1 shows the infant holding device 104 in a detached state, whereas FIG. 2 shows the infant holding device 104 installed on the swing apparatus 100). The support frame 102 can comprise a first side 102A, a second side 102B opposite to the first side 102A, a third side 102C contiguous to the first and second side 102A and 102B, and a fourth side 102D opposite to the third side 102C.

Each of the opposite first and second sides 102A and 102B of the support frame 102 can include a plurality of upstanding legs 106. More specifically, the upstanding legs 106 can be formed as two assemblies of tubular structures having a generally U-shape or V-shape. The two assemblies of upstanding legs 106 are spaced apart from each other by a space in which is provided a mount platform 110 adapted to receive the installation of the infant holding device 104. The mount platform 110 is movably connected with a plurality of swing arms 116 and 118 that are pivotally coupled with the support frame 102. The swing arms 116 and 118 can hold the mount platform 110, and also swing the mount platform 110 (and infant holding device 104 placed thereon) relative to the legs 106 between the opposite third and fourth sides 102C and 102D.

Figure 3:
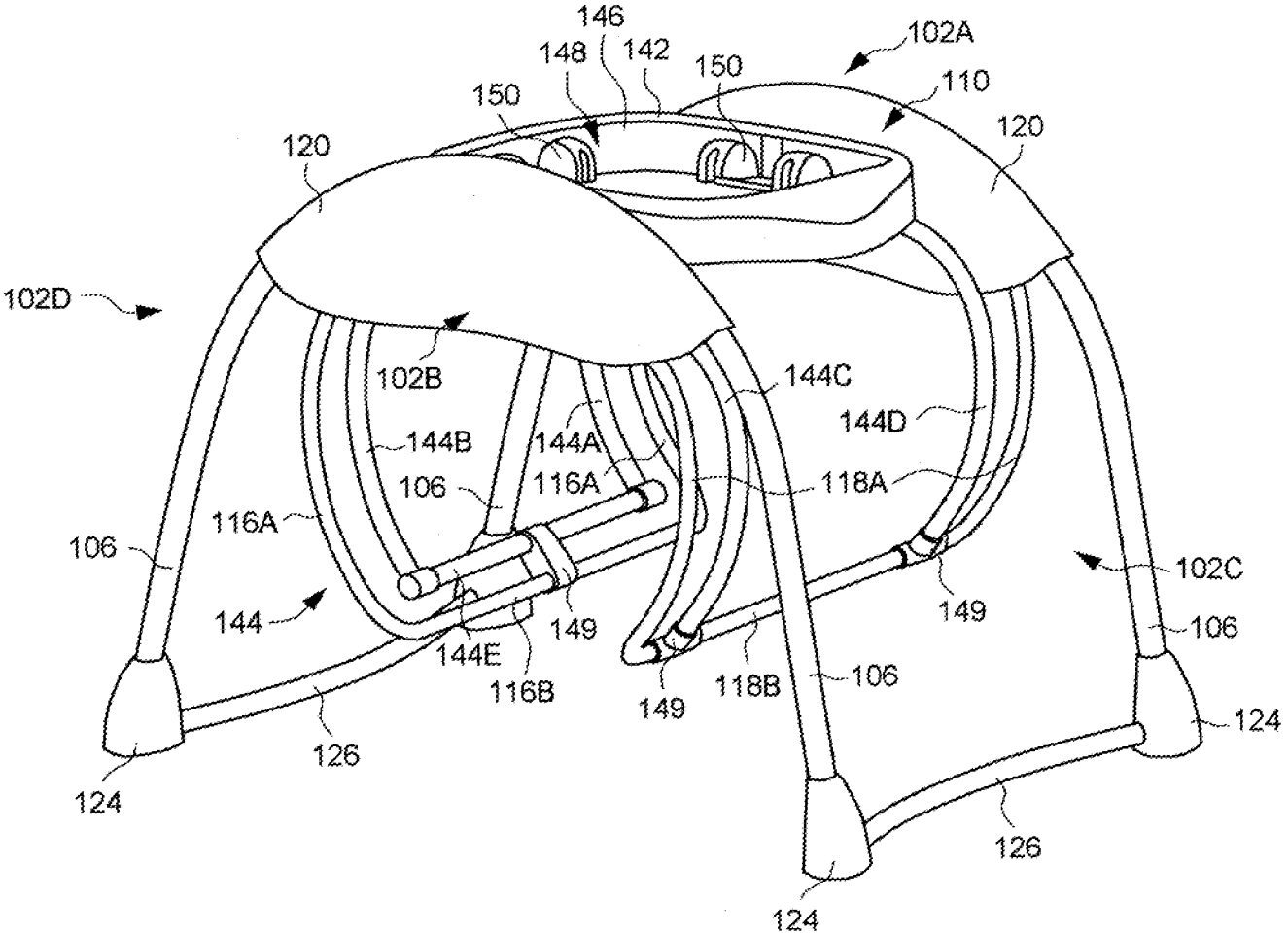
FIG. 3 is a perspective view illustrating a support frame of the swing apparatus.

In conjunction with FIGS. 1 and 2, FIG. 3 is a perspective view illustrating the swing apparatus 100 without the infant holding device 104. As shown, the upstanding legs 106 provided on the first and second sides 102A and 102B of the support frame 102 can respectively have upper ends joined with a housing 120. More specifically, the housing 120 can be formed with a curved shape having a hollow interior for enclosing a motor mechanism that drives the swing motion of the mount platform 110 (and the infant holding device 104 installed thereon). Two opposite sides of the housing 120 can be respectively provided with coupling fixtures 122 (as better shown in FIG. 5A) through which upper ends of the upstanding legs 106 can be fixedly secured inside the housing 120. In turn, lower ends of the upstanding legs 106 can be fixedly secured with anti-slip pads 124. Transverse bars 126 can also be used to link the lower ends of the upstanding legs 106 on the first and second sides 102A and 102B of support frame 102 for keeping the opposite upstanding legs 106 in alignment with each other, promoting stability of the support frame 102.

As shown in FIG. 3, the swing arms 116 and 118 can be assembled between the first and second sides 102A and 102B of the support frame 102, and are disposed symmetrically facing each other on the two opposite sides 102C and 102D. More specifically, each of the swing arms 116 and 118 can have a generally U-shaped profile having two parallel side sections (designated 116A for the swing arm 116 and 118A for the swing arm 118), and a transverse section (designated 116B for the swing arm 116 and 118B for the swing arm 118) joining lower ends of the side sections. In one embodiment, the side sections 116A of the swing arm 116 and side sections 118A of the swing arm 118 can be disposed symmetric to each other and have a curved or arc shape with a curvature oriented toward the center of the support frame 102. In this manner, the weight distribution of the swing arms 116 and 118 may be desirably designed so that swinging movements can be performed in a stable and smooth manner. It is worth noting that while the embodiment shown herein describes a particular shape for the swing arms 116 and 118, any configurations may be possible in general.

Referring to FIG. 3, the upper end of each side section 116A and 118A can be pivotally assembled with the housing 120, such that the swing arms 116 and 118 can perform swinging movements toward the third and fourth sides 102C and 102D of the support frame 102. In turn, the lower transverse sections 116B and 118B of the swing arms 116 and 118 are pivotally coupled with the mount platform 110 to drive it in movement.

Referring again to FIGS. 1 and 3, the mount platform 110 can include a holder frame 142 and a linkage structure 144. In one embodiment, the holder frame 142 may be formed as a closed ring having a peripheral sidewall 146 that encloses a central opening 148 adapted to receive the placement of the infant holding device 104. The sidewall 146 can include a plurality of catch structures 150 that are distributed around the central opening 148 and are adapted to lock with latching elements 152 provided on the infant holding device 104. More specifically, the catch structures 150 may be preferably disposed at rotationally symmetric positions, such that the infant holding device 104 can be fastened with the holder frame 142 according to different positions rotationally shifted in a horizontal plane.

The linkage structure 144 can have upper ends fixedly joined with the holder frame 142, and lower ends that extend downward from the holder frame 142 and pivotally couples with the swing arms 116 and 118. In the illustrated embodiment, the linkage structure 144 can exemplary include four tubular extensions that are disposed symmetrical on two opposite sides of the holder frame 142. For example, two tubular extensions 144A and 144B may be respectively placed adjacent to the side sections 116A of the swing arm 116 and have a curved shape with a curvature oriented in a same direction, whereas the two other tubular extensions 144C and 144D may be respectively disposed adjacent to the side sections 118A of the swing arm 118 and also have a curved shape with a curvature oriented in a same direction as the side sections 118A. The upper ends of the tubular extensions 144A, 144B, 144C and 144D can be fixedly joined with the holder frame 142.

In alternate embodiments, the upper ends of the tubular extensions 144A and 144D can also be joined with each other so as to form an integral C-shaped tubular section that has a profile including the contour of the tubular extensions 144A and 144D. In a similar manner, the upper ends of the tubular extensions 144B and 144C can also be joined with each other so as to form an integral C-shaped tubular section. Therefore, the four tubular extensions 144A, 144B, 144C and 144D may be advantageously integrated to form two C-shaped tubular sections.

The lower ends of the tubular extensions 144A and 144B can be joined with a transverse section 144E. The lower ends of the tubular extensions 144C and 144D and the transverse section 144E can be respectively coupled with the transverse section 116B and 118B of the swing arms 116 and 118 via a plurality of pivot links 149 whose pivot axes are respectively parallel to the axes of the transverse section 116B and 118B of the swing arms 116 and 118 as well as the pivot axes of the pivot links joining the swing arms 116 and 118 with the housings 120. The holder frame 142 can be thereby held by the swing arms 116 and 118 at a suitably raised position above the ground. In one embodiment, the holder frame 142 can be exemplary disposed at a height above the swing arms 116 and 118 and adjacent to the housings 120. Once it is installed on the holder frame 142 of the mount platform 110, the infant holding device 104 can accordingly lie adjacent to the housing 120 and extend above the support frame 102, in particular above the horizontal positions of the pivot links that connect the swing arms 116 and 118 with the support frame 102. As a result, access to the infant holding device 104 can be facilitated for placement and removal of the infant.

As shown in FIG. 1, a detector 160 can be provided on the support frame 102 to provide information about the infant holding device 104, e.g., such as whether it is installed on the holder frame 142, whether the infant holding device 104 is installed properly, and the type of the installed infant holding device 104. This information can be used to desirably set the output parameters of a motor drive unit that drives the swing arms 116 and 118 in movement, for example adjusting the output of the motor drive unit, or even shutting the output of the motor drive unit in case the infant holding device 104 is not properly installed. In this manner, the swing motion can be desirably controlled and adjusted in accordance with the type of the infant holding device 104 installed with the swing apparatus 100. In one embodiment, the detector 160 can be a proximity sensor that is disposed at one or two of the housings 120 at a position adjacent to the holder frame 142, and is adapted to detect the proximate presence of an infant holding device 104. The detector 160 can include an infrared light source that emits a source signal (e.g., infrared light beam) toward the position of the infant holder device 104, and a light sensor that can detect a return signal in response to the source signal. As each type of the infant holding device 104 can be designed with a different physical structure, the return signal can allow the detector 160 to provide information as to whether a specific type of the infant holding device is currently installed on the swing apparatus 100, and then output a signal for adjusting the mode of operation of the motor drive unit.

In other embodiments, the detector 106 can include an optical scanner that can read identification marks (e.g., bar codes). The identification mark may be provided on the infant holding device 104. As the infant holding device 104 is installed on the support frame 102, the scanner can read the identification mark to determine the installation and type of the infant holding device 104.

Figure 4A:
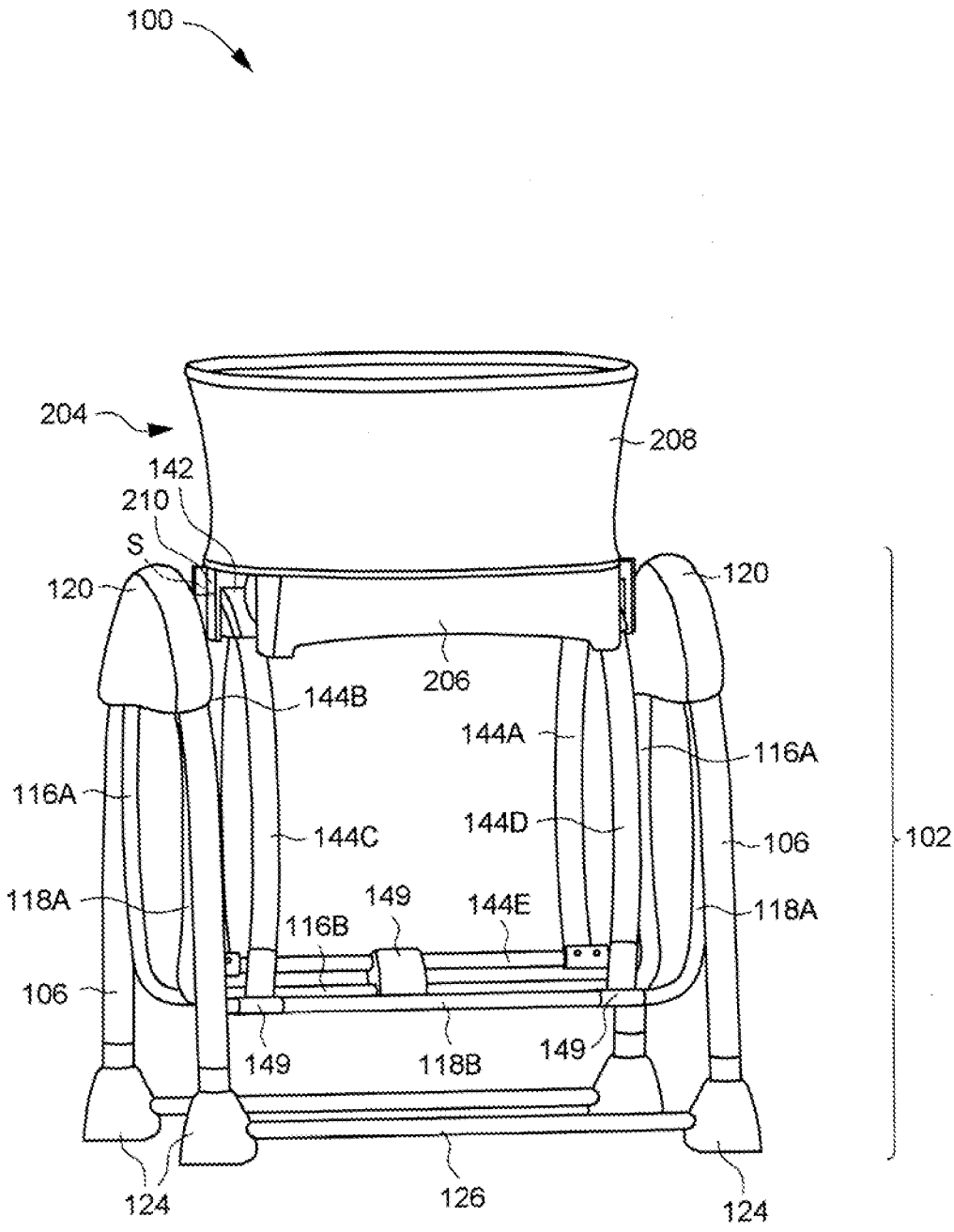
FIG. 4A is a schematic view illustrating a bassinet installed with the swing apparatus.
Figure 4B:
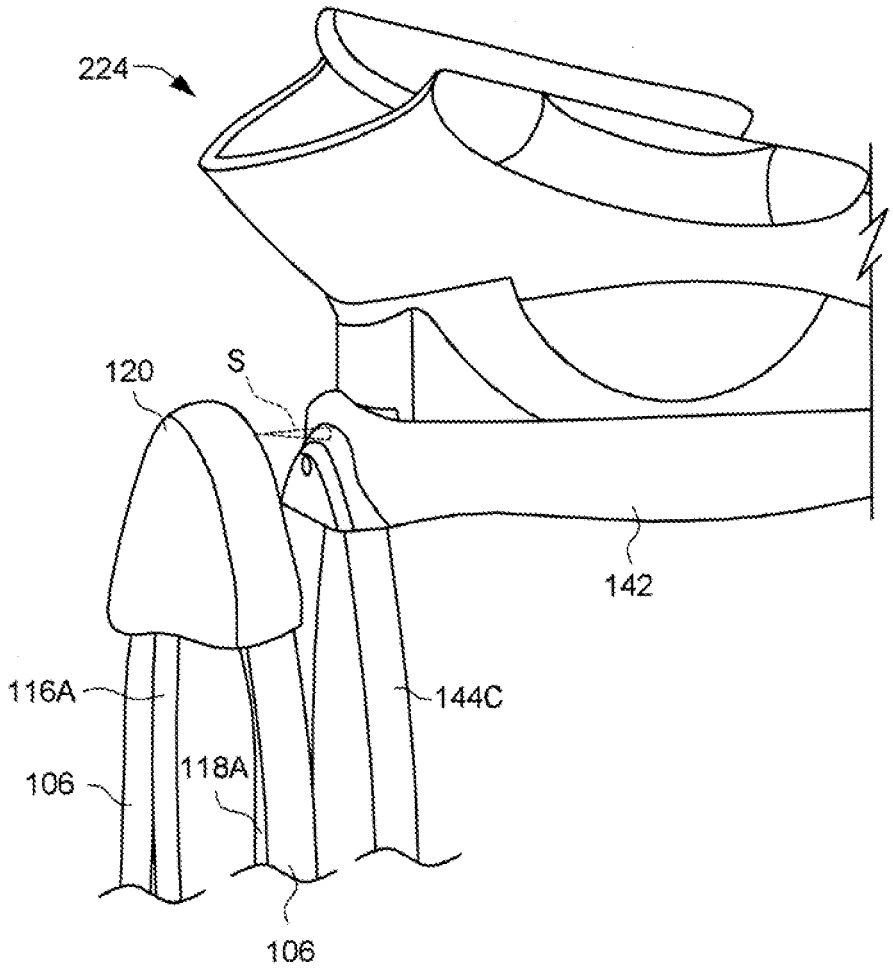
FIG. 4B is a schematic view illustrating an infant seat installed with the swing apparatus.

FIGS. 4A and 4B are schematic views illustrating different examples of infant holding devices that may be installed on the swing apparatus. In FIG. 4A, a first infant holding device 204 installed on the support frame 102 is exemplary a bassinet, which can receive a child in a sleeping position. The infant holding device 204 can include a base 206, and an enclosure 208 assembled with the base 206 that defines an inner space in which a child can be placed. One or more lateral side of the infant holding device 204 can have a sidewall 210 that lies adjacent to the detector 160 once the first infant holder device 204 is installed on the mount platform 110. Owing to the sidewall 210, the detector 160 can detect a return signal indicating the presence of the bassinet in response to the output of a source signal S.

In FIG. 4B, a second infant holding device 224 installed on the swing apparatus can be exemplary a portable infant seat, which has a sidewall smaller than the bassinet. Because the lateral side of the second infant holding device 224 has a different physical structure with no adjacent target structure such as the sidewall 210 previously described, the corresponding return signal allows the detector 160 to provide information that the second infant holding device 224 is not a bassinet. Based on the information provided by the detector 160, the output of a motor drive unit can be modified to adjust the velocity and/or amplitude of the swing arms 116 and 118.

It is worth noting that other detector designs may also be applicable. For example, in alternate embodiments, the mount platform 110 may incorporate an internal detector circuit that can have a conducting or closed-circuit state, and an open-circuit state. The installation of the infant holding device 104 on the swing apparatus 100 may establish electrical connection with this internal detector circuit incorporated in the mount platform 110. On the other hand, the detector circuit can be in an open-circuit state when there is no infant holding device installed, or when the infant holding device is installed improperly. Accordingly, this electrical connection may be used to detect a certain type of the infant holding device 104 installed with the swing apparatus.

Figure 5A:
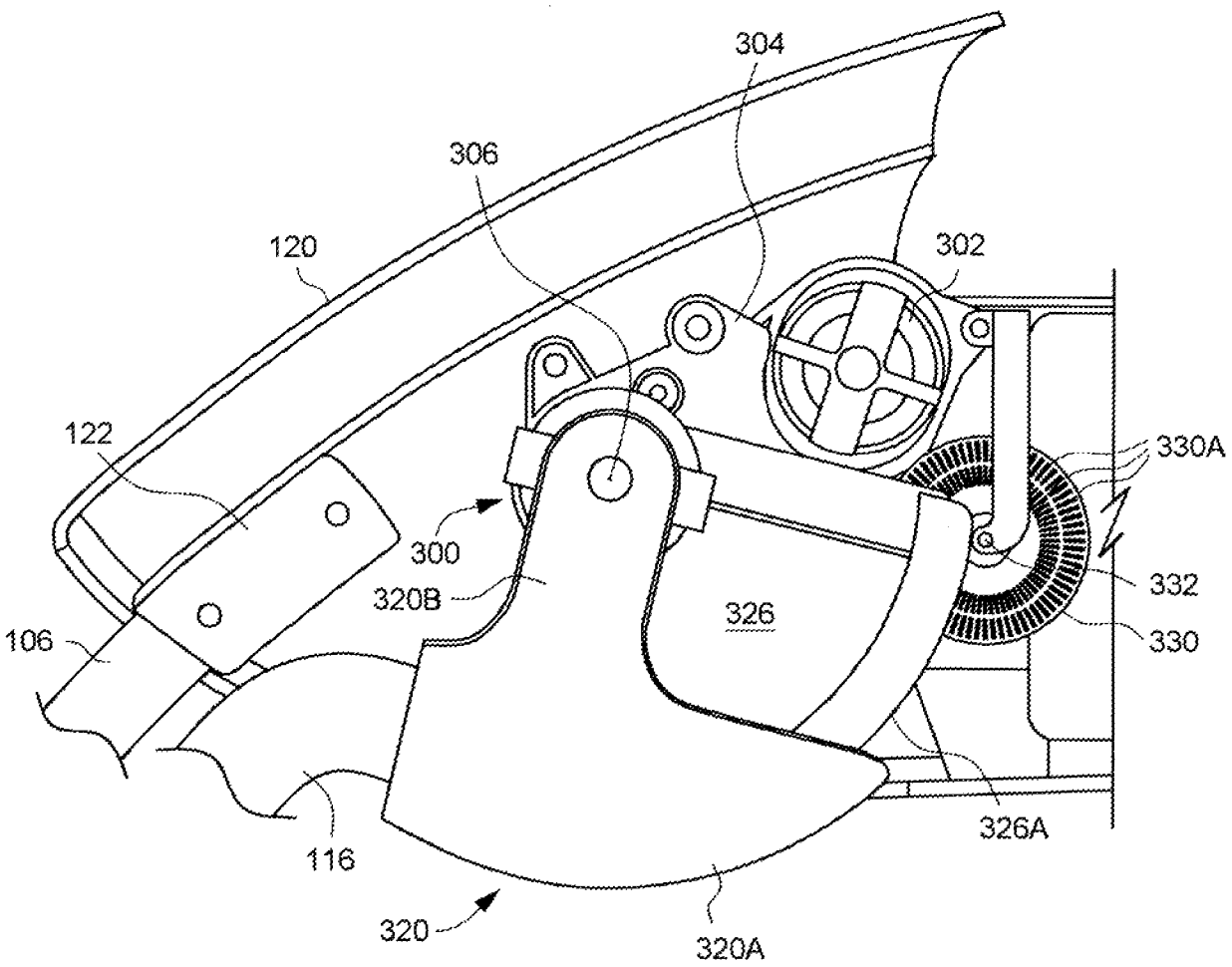
FIG. 5A is a schematic view of a drive unit used to drive the swing motion of the swing apparatus.
Figure 5B:
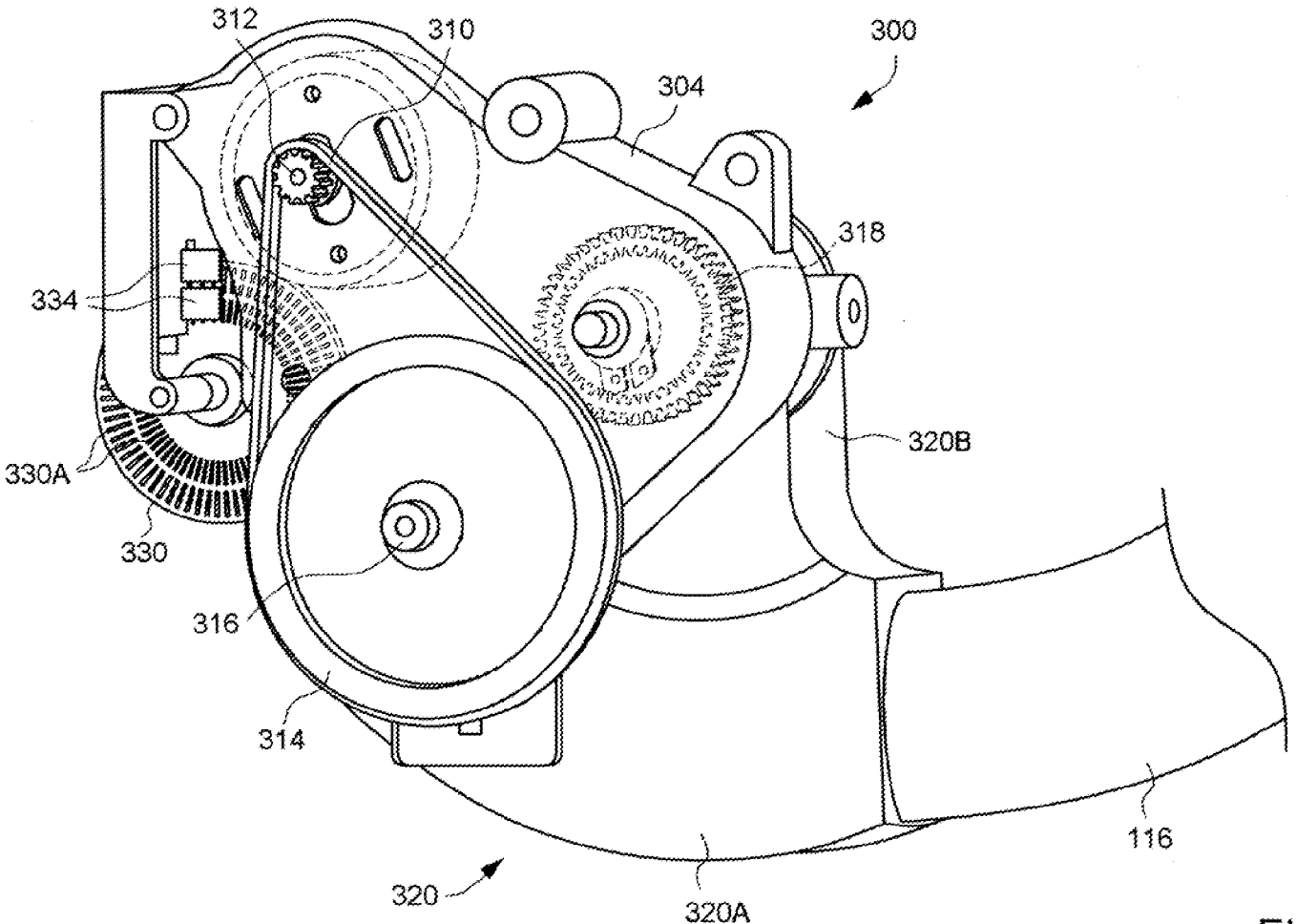
FIG. 5B is a schematic view illustrating the drive unit from an opposite side of FIG. 5A.

FIG. 5A is a schematic view of a drive unit 300 used to drive the swing motion of the swing apparatus 100, and FIG. 5B is a schematic view illustrating the drive unit 300 from an opposite side of FIG. 5A. The drive unit 300 is assembled in the interior of one of the two housings 120, and can be coupled with one of the swing arms (for example, the swing arm 116, but the drive unit 300 may also be coupled with the other swing arm 118). The drive unit 300 can include an electric motor 302, a gear box 304, and a first pivot shaft 306. Examples of the electric motor 302 can include DC motors that may be controlled by a pulse width modulation (PWM) controller.

The gear box 304 can include transmission elements adapted to modify the output of the electric motor 302 (e.g., velocity and torque at the motor output shaft), and transmit the adapted motor output to the first pivot shaft 306. As shown in FIG. 5B, examples of these transmission elements can include a transmission belt 310 that is wrapped around an output axle 312 of the electric motor 302 and a reduction wheel 314 coupled with a rotary shaft 316. The use of the transmission belt 310 can reduce the occurrence of parasitic noise when the electric motor 302 delivers higher velocity outputs. In turn, rotation from the shaft 316 can be transmitted to the first pivot shaft 306 via gear sets 318 (shown with phantom lines) in the gear box 304. The first pivot shaft 306 is coupled with the swing arm 116 via a coupling element 320, such that rotation of the first pivot shaft 306 can cause corresponding angular movement of the swing arm 116. With this construction, the gear box 304 can modify the output of the electric motor 302 and reduce parasitic noise induced by the meshed gears. Accordingly, the swing apparatus can operate more silently to prevent sound disturbance and provide effective comfort to the child.

In one embodiment, the coupling element 320 can have a shoe shape with a hollow first portion 320A fixedly secured with the distal end of the swing arm 116, and a second portion 320B provided with a hole through which the first pivot shaft 306 may be affixed. Moreover, the coupling element 320 can include a radial portion 326 that is approximately centered on the axis of the first pivot shaft 306 and has a peripheral edge surface 326A formed with an arc shape. In one embodiment, the coupling element 320, including the first and second portions 320A and 320B and the radial portion 326, can be formed integral in a single body by plastics molding.

Referring again to FIGS. 5A and 5B, in order to control the velocity and angular displacement of the swing arm 116, an encoder wheel 330 may be operatively coupled with one of the first pivot shaft 306, the coupling element 320 and the swing arm 116. In the illustrated embodiment, the encoder wheel 330 can be exemplary secured with a second pivot shaft 332 that is assembled with the housing 120 at a position spaced apart from the first pivot shaft 306. The second pivot shaft 332 is positioned independently apart from the gear box 304 and the motor 302 in the movement transmission chain for driving the first pivot shaft 306. More specifically, the second pivot shaft 332 is placed at a downstream position in the driving chain rather than being coupled with the driving source, i.e., the electric motor 302. The second pivot shaft 332 has an outer circular surface in frictional contact with the peripheral edge surface 326A of the radial portion 326. In this manner, rotation of the first pivot shaft 306 can result in corresponding angular or rotational displacement of the second pivot shaft 332.

Figure 5C:
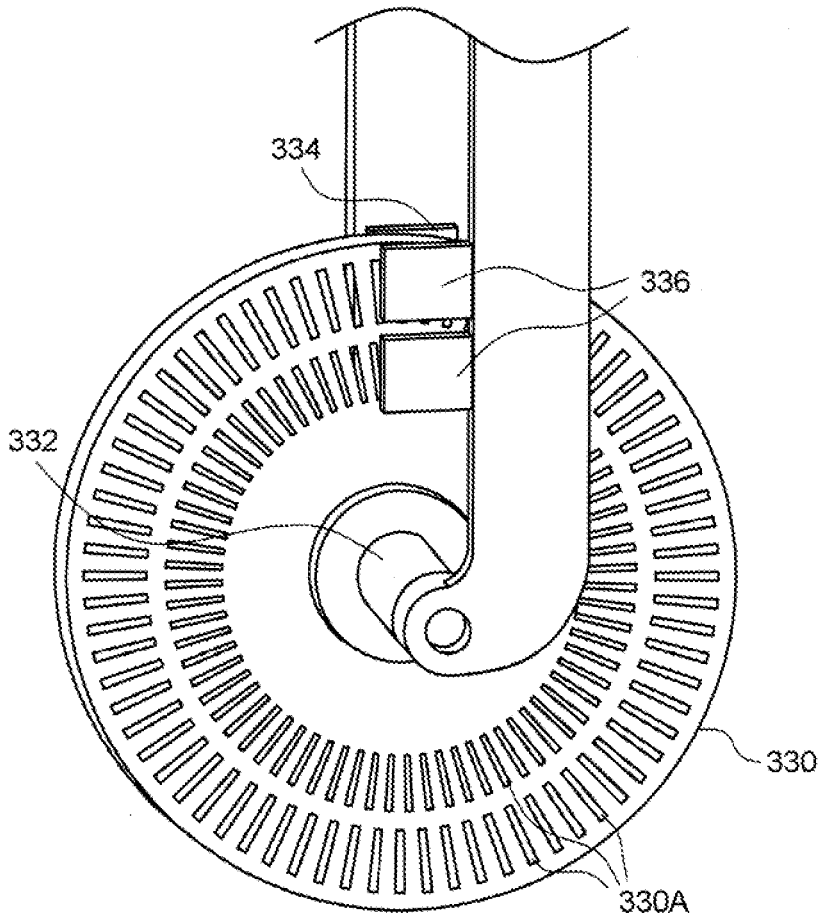
FIG. 5C is an enlarged view of the encoder wheel.

FIG. 5C is an enlarged view of the encoder wheel 330. The encoder wheel 330 can include a plurality of slits 330A distributed in two annular arrays of different radii that are centered on the same second pivot shaft 332. In one embodiment, the positions of the slits 330A from the two annular arrays can be offset from one another to form a quadrature encoder. Moreover, light sources 334 (for example infrared light) can be placed at one side of the encoder wheel 330, and light sensors 336 (for example, comprised of two photo-sensitive transistors respectively associated with the two annular arrays of the slits 330A) can be placed at the other side of the encoder wheel 330 opposite to the light sources 334.

Driven by the motor 302, the first pivot shaft 306 and the coupling element 320 can rotate to generate a swing motion of the swing arm 116. Owing to the static frictional contact between the radial portion 326 of the coupling element 320 and the second pivot shaft 332, the second pivot shaft 332 and the encoder wheel 330 are also driven in synchronous rotation in a direction that is opposite to that of the first pivot shaft 306. By detecting and counting the slits 330A of the encoder wheel 330 that pass through the light sensors 336, the rotation of the encoder wheel 330 can be measured to derive the angular displacement and velocity of the swing arm 116, and proper control signals can be issued to control the motor 302. It is worth noting that because the second pivot shaft 332 is not directly coupled with the drive unit, the measure of rotation provided from the encoder wheel 330 is not affected by internal backlashes that may occur in the drive unit (e.g., within the gear box 304). Accordingly, any change in the direction of rotation of the first pivot shaft 306 can be accurately detected as an instantaneous change in the direction of rotation of both the second pivot shaft 332 and the encoder wheel 330.

Figure 6:
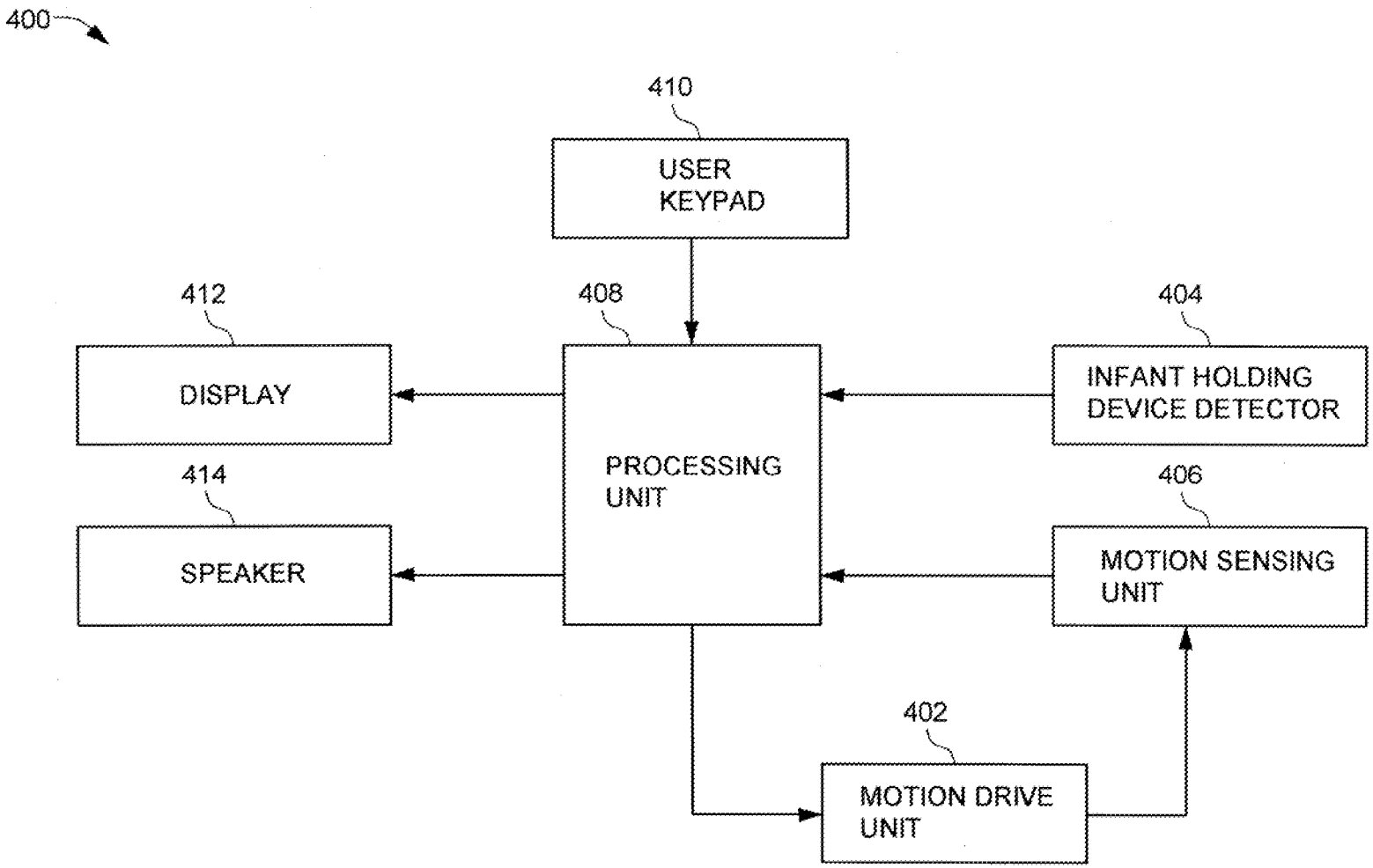
FIG. 6 is a simplified block diagram illustrating one embodiment of a swing control system used in the swing apparatus.

FIG. 6 is a simplified block diagram illustrating one embodiment of a swing control system 400 that may be used in the swing apparatus 100. The control system 400 can include a motion drive unit 402, an infant holding device detector 404, a motion sensing unit 406, a processing unit 408, a user keypad 410, a display 412 and a speaker 414. The motion drive unit 402 can include the electric motor 302, a motor drive controller, the gear box 304 and the first pivot shaft 306 described previously. The output of the motion drive unit 402 can be coupled with the swing arm 116 to impart a swing motion to the swing arms 116 and 118 and the infant holding device 104. The infant holding device detector 404 can include the proximity detector 160 described previously adapted to provide information about whether a specific type of the infant holding device 104 is installed with the swing apparatus 100. The motion sensing unit 406 can include the aforementioned encoder wheel 330, second pivot shaft 332, light sources 334 and sensors 336 used to measure angular displacement and velocity information of the swing arm 116. The processing unit 408 can be an integrated circuit (IC) processing unit adapted to receive information from the infant holding device detector 404 and the motion sensing unit 406, derive an angular displacement and other information associated with the first pivot shaft 306 and swing arm 116, and output control signals to the motion drive unit 402 to control the direction of rotation, torque and velocity of the motor 302.

Figure 7:
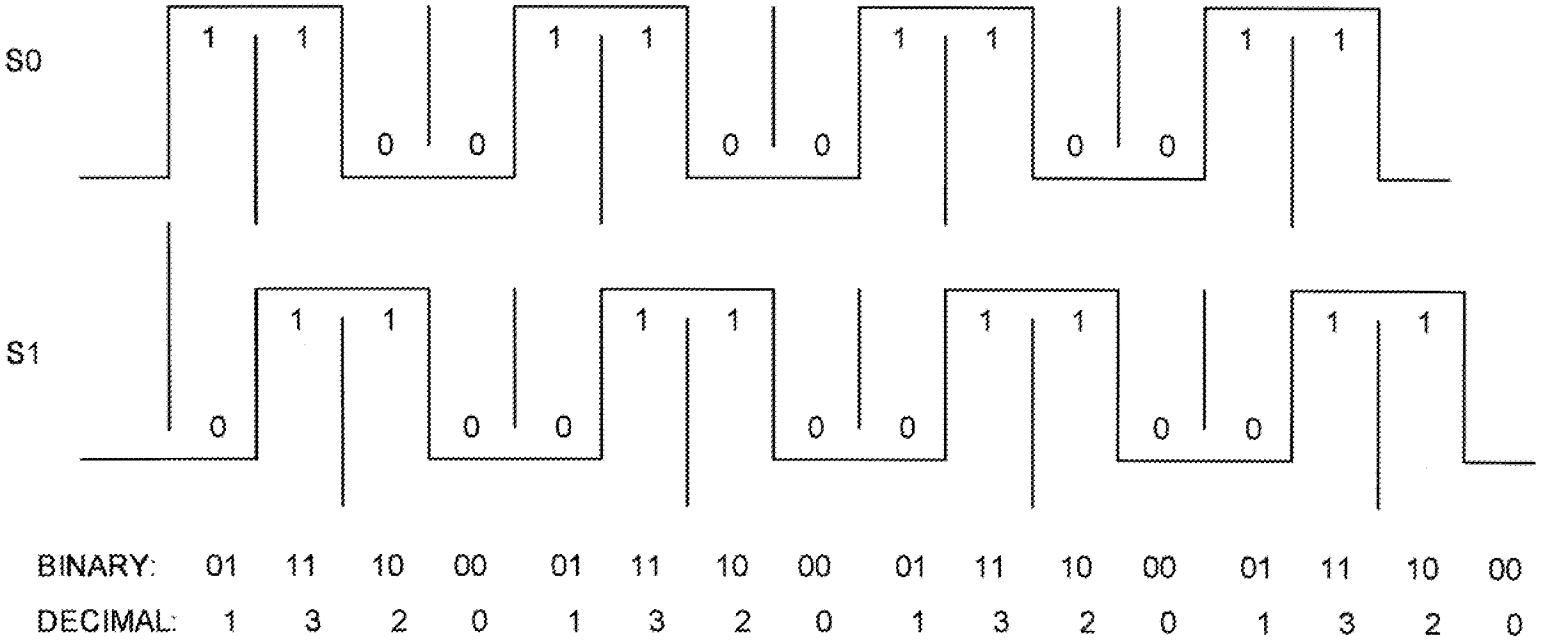
FIG. 7 is a timing diagram showing examples of data signals that may be sensed through a motion sensing unit of the swing control system shown in FIG. 6.

In the aforementioned control system 400, the information outputted from the motion sensing unit 406 can be used to determine when the swing motion changes direction, so that control signals can be sent to the motion drive unit 402 with a proper polarity in accordance with the swing direction. For illustration, FIG. 7 is a timing diagram showing examples of data signals that may be sensed through the encoder wheel 330 of the motion sensing unit 408 for one given direction of the swing motion. Because the positions of the slits 330A are offset from one annular array to the other, two rectangular waveform signals S0 and S1 timely shifted can be generated at the sensors 336 as the swing motion occurs in a given direction. The information conveyed through these two signals S0 and S1 can contain a pattern of numerical code (e.g., the succession of the same binary pattern "01-11-10-00" or decimal pattern "1-3-2-0") that is associated with the swing movement in the first direction. On the other hand, when the swing movement is in the opposite direction, the information conveyed through the signals S0 and S1 can contain a reversed pattern of numerical code (e.g., the succession of the binary pattern "00-10-11-01" or decimal pattern "0-2-3-1"). Accordingly, a change of direction in the swing motion can be determined by detecting a discontinuity in the repeated patterns of numerical codes provided by the motion sensing unit 406. In addition to this information, the amplitude of the swing motion can also be determined by counting the number of slits 330A that pass by the sensors 336 when the swing arms are moving in one direction.

Figure 8:
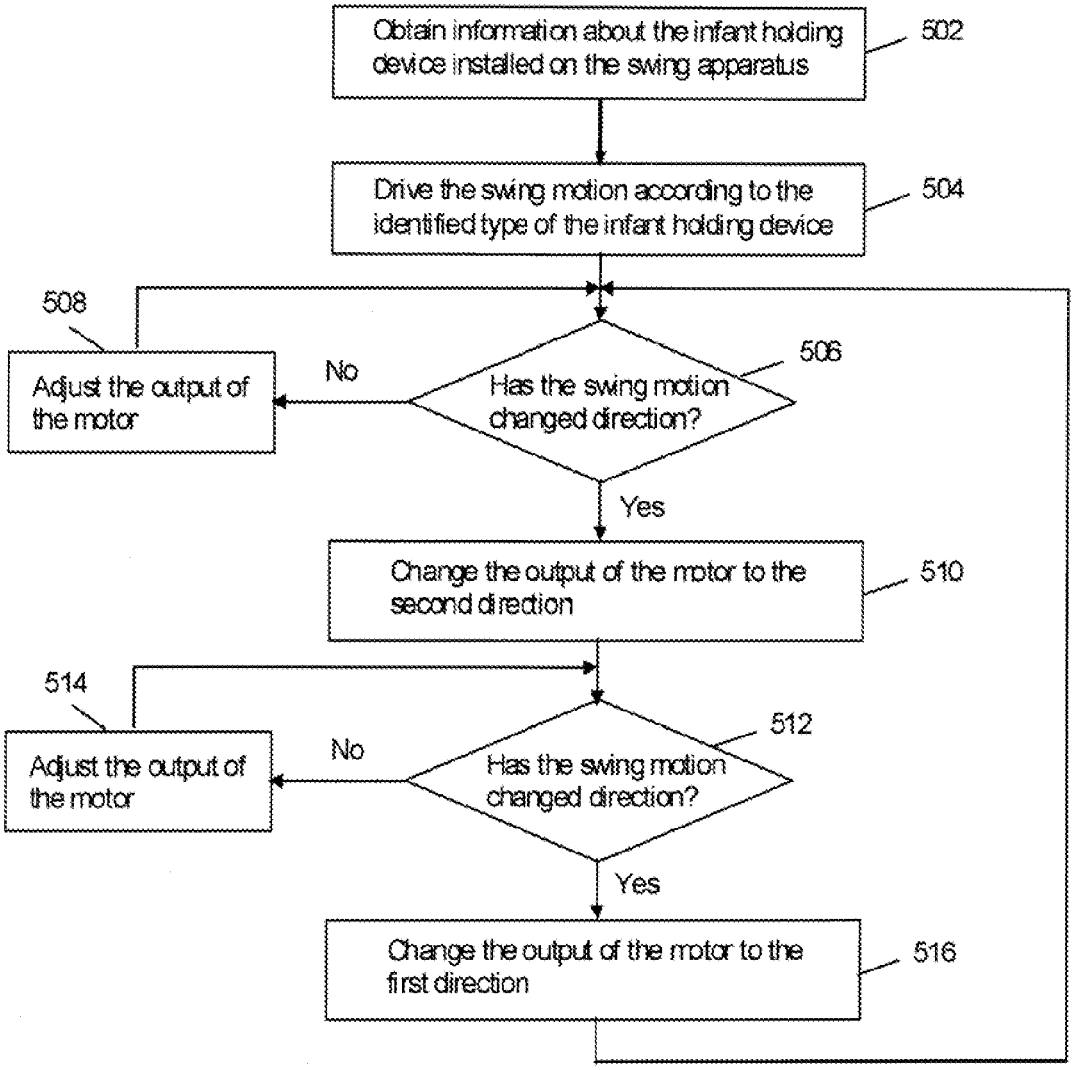
FIG. 8 is a flowchart of method steps to control the swing motion of the swing apparatus.

FIG. 8 is a flowchart of exemplary method steps to control the swing motion of the swing apparatus 100. In step 502, information about whether an infant holding device is installed on the swing apparatus is provided to the processing unit 408. As described above, the infant holding device detector 404 can be used to obtain this information, which can indicate the type of the installed infant holder device, e.g., whether it is a bassinet (as shown in FIG. 4A) or other types of infant holding devices (such as shown in FIG. 4B). In alternate embodiments, the type of the infant holding device installed may also be directly identified and inputted by the caregiver via the user keypad 410.

In step 504, according to the identified type of the infant holding device, the processing unit 408 can then send appropriate control signals (for example, pulse-width modulation (PWM) signal) to the motion drive unit 402 to drive its swing motion. As each type of the infant holding device may differ in weight and size, the output of the motion drive unit 402 may be adjusted to properly swing the infant holding device. For example, in case the infant holding device is a bassinet (as shown in FIG. 4A), a gentle swing motion of smaller amplitude may also be preferable for helping the child to sleep, whereas faster swing motion with greater amplitude may be suitable when the infant holding device is an infant seat (as shown in FIG. 4B).

In step 506, as the motor 302 rotates in a first direction, the processing unit 408 can continuously receive information from the motion sensing unit 406 to derive a current angular displacement of the first pivot shaft 306 and swing arm 116 and determine whether the swing motion has changed direction. In case the direction of the swing motion has not changed, the processing unit 408 in step 508 may issue a control signal to adjust the output of the motor 302 (e.g., its velocity) according to the current angular displacement of the swing arms. Steps 506 and 508 may be repeated as long as the swing motion has not changed direction.

Once a change of direction in the swing motion of the swing arms has been detected, the processing unit 408 in step 510 can issue an associated control signal to modify the output of the motor 302 so that it can rotate in a second direction.

In step 512, as the motor 302 rotates in the second direction, the processing unit 408 can receive information from the motion sensing unit 406 to derive a current angular displacement of the first pivot shaft 306 and swing arm 116 and determine whether the swing motion has changed direction. In case the direction of the swing motion has not changed, the processing unit 408 in step 514 may issue a control signal to adjust the output of the motor 302 (e.g., its velocity) according to the current angular displacement of the swing arms. Steps 512 and 514 may be repeated as long as the swing motion has not changed direction.

Once a change of direction in the swing motion of the swing arms has been detected, the processing unit 408 in step 516 can issue an associated control signal to modify the output of the motor 302 so that it can rotate in the first direction. The method then can loop to step 506 to control the swing motion in the first direction as described previously.

At least one advantage of the apparatus and method described herein is the ability to adjust the motor output of the swing apparatus according to the type of the infant holding device installed thereon. Accordingly, the most suitable swing motion can be imparted to the infant holding device.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. A swing apparatus comprising:

a detachable infant holding device;

at least a swing arm pivotally connected with a support frame, wherein the swing arm is adapted to impart a swing motion to the infant holding device when the infant holding device is installed on the swing arm; and a detector disposed at a location in the swing apparatus suitable to provide information about the installation of the infant holding device on the swing arm of the swing apparatus or about a type of the infant holding device installed thereon.

2. The swing apparatus according to claim 1, wherein the detector is placed on the support frame.

3. The swing apparatus according to claim 1, wherein the information provided by the detector is indicative of whether the installed infant holding device is a bassinet.

4. The swing apparatus according to claim 1, wherein the detector includes a proximity detector.

5. The swing apparatus according to claim 1, further comprising a motor drive unit operable to drive the swing arm in movement.

6. The swing apparatus according to claim 5, wherein the motor drive unit is configured to adjust the movement of the swing arm according to the information provided by the detector.

7. The swing apparatus according to claim 5, further comprising a motion sensing unit adapted to measure second information related to a direction, velocity and amplitude of the movement of the swing arm.

8. The swing apparatus according to claim 7, wherein the motor drive unit is configured to adjust the movement of the swing arm according to the second information provided by the motion sensing unit.

9. A control system for a swing apparatus, comprising:

a motor drive unit having an output coupled with a swing arm of the swing apparatus, wherein the motor drive unit is operable to drive the swing arm in movement; and a processing unit adapted to adjust the output of the motor drive unit according to a type of an infant holding device installed on the swing apparatus.

10. The control system according to claim 9, further comprising a detector adapted to provide information about the type of the infant holding device installed on the swing apparatus.

11. The control system according to claim 10, wherein the information provided by the detector is indicative of whether the installed infant holding device is a bassinet.

12. The control system according to claim 10, wherein the detector includes a proximity detector.

13. The control system according to claim 9, wherein the type of the infant holding device is inputted via a user keypad.

14. The control system according to claim 9, further comprising a motion sensing unit connected with the processing unit, wherein the motion sensing unit is adapted to measure second information related to a direction, velocity and amplitude of the movement of the swing arm.

15. The control system according to claim 14, wherein the processing unit is further adapted to adjust the output of the motor drive unit according to the second information provided by the motion sensing unit.

16. A method of driving a swing apparatus, comprising:

providing information about an installation of an infant holding device with the swing apparatus or about a type of the infant holding device installed therewith; and according to the provided information, adjusting an output of a motor drive unit operable to drive a swing motion of the infant holding device.

17. The method according to claim 16, wherein the provided information indicates whether the installed infant holding device is a bassinet.

18. The method according to claim 16, wherein the step of providing information about the infant holding device comprises detecting a type of the infant holding device installed on the swing apparatus.

19. The method according to claim 16, wherein the step of providing information about the infant holding device comprises inputting a type of the infant holding device installed on the swing apparatus.

20. The method according to claim 16, further comprising sensing movement parameters of a swing arm that drives the infant holding device in movement.

* * * * *